US009688948B2

(12) United States Patent
Osler et al.

(10) Patent No.: US 9,688,948 B2
(45) Date of Patent: Jun. 27, 2017

(54) LAUNDRY DETERGENT PARTICLES

(71) Applicant: Conopco, Inc., Englewood Cliffs, NJ (US)

(72) Inventors: Jonathan Osler, Port Sunlight (GB); David Christopher Thorley, Shavington (GB)

(73) Assignee: CONOPCO, INC., Englewood Cliffs, NJ (US)

( * ) Notice: Subject to any disclaimer, the term of this patent is extended or adjusted under 35 U.S.C. 154(b) by 29 days.

(21) Appl. No.: 14/425,515

(22) PCT Filed: Sep. 20, 2013

(86) PCT No.: PCT/EP2013/069643
§ 371 (c)(1),
(2) Date: Mar. 3, 2015

(87) PCT Pub. No.: WO2014/048857
PCT Pub. Date: Apr. 3, 2014

(65) Prior Publication Data

US 2015/0225680 A1 Aug. 13, 2015

(30) Foreign Application Priority Data

Sep. 25, 2012 (EP) ..... 12185831

(51) Int. Cl.

| | |
|---|---|
| ***C11D 17/00*** | (2006.01) |
| ***C11D 1/02*** | (2006.01) |
| ***C11D 1/66*** | (2006.01) |
| ***C11D 3/10*** | (2006.01) |
| ***C11D 3/12*** | (2006.01) |
| ***C11D 3/04*** | (2006.01) |
| ***C11D 11/00*** | (2006.01) |

(52) U.S. Cl.
CPC ..... *C11D 17/0039* (2013.01); *C11D 1/02* (2013.01); *C11D 1/66* (2013.01); *C11D 3/046* (2013.01); *C11D 3/10* (2013.01); *C11D 3/122* (2013.01); *C11D 3/1233* (2013.01); *C11D 11/0017* (2013.01)

(58) Field of Classification Search
None
See application file for complete search history.

(56) References Cited

U.S. PATENT DOCUMENTS

| | | | | |
|---|---|---|---|---|
| 4,040,988 | A | 8/1977 | Benson | |
| 4,788,005 | A * | 11/1988 | Castro | C11D 3/046 510/108 |
| 4,908,159 | A | 3/1990 | Davies et al. | |
| 8,883,702 | B2 * | 11/2014 | Bonsall | B65D 41/26 510/293 |
| 2002/0004476 | A1 | 1/2002 | Pancheri | |
| 2006/0162884 | A1 | 7/2006 | Gane et al. | |
| 2010/0069282 | A1 * | 3/2010 | Prabhat | C11D 3/40 510/276 |

FOREIGN PATENT DOCUMENTS

| | | | |
|---|---|---|---|
| CN | 86103749 | | 11/1986 |
| EP | 0110588 | | 6/1984 |
| MX | 2014011527 | | 1/2015 |
| WO | WO0177273 | | 10/2001 |
| WO | WO2009120526 | | 10/2009 |
| WO | WO 2010/122050 | A2 * | 10/2010 |
| WO | WO 2010/122051 | A1 * | 10/2010 |
| WO | WO 2011/058032 | A1 * | 5/2011 |
| WO | WO2012049178 | | 4/2012 |
| WO | WO2013149752 | | 10/2013 |
| WO | WO2013149753 | | 10/2013 |

OTHER PUBLICATIONS

Search Report in EP12185831 dated Feb. 5, 2013.
Search Report in PCTEP2013069643 dated Nov. 28, 2013.
Written Opinion in EP12185831 dated Feb. 5, 2013.
Written Opinion in PCTEP2013069643 dated Nov. 28, 2013.

* cited by examiner

*Primary Examiner* — Lorna Douyon
(74) *Attorney, Agent, or Firm* — Foley & Lardner LLP

(57) ABSTRACT

The present invention provides a coated detergent particle having perpendicular dimensions x, y and z, wherein x is from 0.5 to 2 mm, y is from 2 to 8 mm, and z is from 2 to 8 mm, wherein the particle comprises: (i) from 20 to 39 wt % of a surfactant selected from: anionic and non-ionic surfactants; (ii) from 10 to 40 wt % of an inorganic salt coating selected from: sodium carbonate and/or sodium sulphate of which at least 5 wt % of the inorganic salt is sodium carbonate; and, (iii) from 10 to 40 wt % of calcite having a median particle size average diameter (D50) in the range from 10 to 70 microns, and wherein the inorganic salts are present on the detergent particle as a coating and the surfactant is present in a core with the calcite dispersed through the core.

19 Claims, No Drawings

LAUNDRY DETERGENT PARTICLES

FIELD OF INVENTION

The present invention relates to large laundry detergent particles.

BACKGROUND OF INVENTION

WO 2012/049178 discloses the incorporation of sodium silicate into a carbonate coating of large detergent particle. The sodium silicate is disclosed as reducing the water ingress into the surfactant core of the large detergent particle.

SUMMARY OF THE INVENTION

We have found that by incorporating powdered calcite into a surfactant core of a carbonate coated large detergent particle aids the longevity of the integrity of the particle when the particle is exposed to atmospheric conditions. The particles retain a better ability to flow from packaging than similar particles that do not have powdered calcite in the core.

In one aspect the present invention provides a coated detergent particle having perpendicular dimensions x, y and z, wherein x is from 0.5 to 2 mm, y is from 2 to 8 mm, and z is from 2 to 8 mm, wherein the particle comprises:

(i) from 20 to 39 wt % of a surfactant selected from: anionic and non-ionic surfactants;

(ii) from 10 to 40 wt % of an inorganic salt coating selected from: sodium carbonate and/or sodium sulphate of which at least 5 wt % of the inorganic salt is sodium carbonate; and, (iii) from 10 to 40 wt % of calcite having a median particle size average diameter (D50) in the range from 10 to 70 microns, and wherein the inorganic salts and are present on the detergent particle as a coating and the surfactant is present a core with the calcite dispersed though the core.

Unless otherwise stated all wt % refer to the total percentage in the particle as dry weights.

DETAILED DESCRIPTION OF THE INVENTION

Shape

Preferably the coated laundry detergent particle is curved.

The coated laundry detergent particle may be lenticular (shaped like a whole dried lentil), an oblate ellipsoid, where z and y are the equatorial diameters and x is the polar diameter; preferably y=z.

The coated laundry detergent particle may be shaped as a disc.

Preferably the coated laundry detergent particle does not have hole; that is to say, the coated laundry detergent particle does not have a conduit passing there though that passes through the core, i.e., the coated detergent particle has a topologic genus of zero.

Core

The core comprises calcite and surfactant.

Surfactant

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981. Preferably the surfactants used are saturated.

Anionic Surfactants

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum. Most preferred anionic surfactants are sodium lauryl ether sulfate (SLES), particularly preferred with 1 to 3 ethoxy groups, sodium $C_{10}$ to $C_{15}$ alkyl benzene sulphonates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides. The chains of the surfactants may be branched or linear.

Soaps may also be present. The fatty acid soap used preferably contains from about 16 to about 22 carbon atoms, preferably in a straight chain configuration. The anionic contribution from soap is preferably from 0 to 30 wt % of the total anionic.

Nonionic Surfactants

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Preferred nonionic detergent compounds are $C_6$ to $C_{22}$ alkyl phenol-ethylene oxide condensates, generally 5 to 25 EO, i.e. 5 to 25 units of ethylene oxide per molecule, and the condensation products of aliphatic $C_8$ to $C_{18}$ primary or secondary linear or branched alcohols with ethylene oxide, generally 5 to 50 EO. Preferably, the non-ionic is 10 to 50 EO, more preferably 20 to 35 EO. Alkyl ethoxylates are particularly preferred.

Preferably all the surfactants are mixed together before being dried. Conventional mixing equipment may be used. The surfactant core of the laundry detergent particle may be formed by extrusion or roller compaction and subsequently coated with an inorganic salt.

Calcite

The calcite was commercially available from Omya but calcite powder of differing size distribution is widely available. The particle size of the calcite was measured using laser diffraction technique to determine the median diameter particle size average (D50). The D50 is the size in microns that splits the distribution with half above and half below this diameter; the D50 is also referred to as the median.

The D50, the median, has been defined above as the diameter where half of the population lies below this value. Similarly, 90 percent of the distribution lies below the D90, and 10 percent of the population lies below the D10.

The laser diffraction technique used to measure the D50 was a Sympatec Helos (H1438) and Rodos. The calcite used was Omya 40 calcite and Omya 5 calcite.

The size of the Omya 40 calcite was examined and was found to have the following diameter size distribution 10% (1.93 micron), distribution 50% (24.01 micron) and distribution 90% (70.08 micron).

The size of the Omya 5 calcite was examined and was found to have the following diameter size distribution 10% (0.70 micron), distribution 50% (4.22 micron), and distribution 90% (14.88 micron).

Coating

Inorganic Salts

The water-soluble inorganic salt is present as a coating on the particle. The water-soluble inorganic salt is preferably present at a level that reduces the stickiness of the laundry detergent particle to a point where the particles are free flowing.

It will be appreciated by those skilled in the art that while multiple layered coatings, of the same or different coating materials, could be applied, a single coating layer is preferred, for simplicity of operation, and to maximise the thickness of the coating.

The coating is preferably applied to the surface of the surfactant core, by deposition from an aqueous solution of the water soluble inorganic salt. In the alternative coating can be performed using a slurry. The aqueous solution preferably contains greater than 50 g/L, more preferably 200 g/L of the salt. An aqueous spray-on of the coating solution in a fluidised bed has been found to give good results and may also generate a slight rounding of the detergent particles during the fluidisation process. Drying and/or cooling may be needed to finish the process.

The Coated Laundry Detergent Particle

Preferably, the coated laundry detergent particle comprises from 10 to 100 wt %, more preferably 50 to 100 wt %, of a laundry detergent formulation in a package. The package is that of a commercial formulation for sale to the general public and is preferably in the range of 0.01 kg to 5 kg, preferably 0.02 kg to 2 kg, most preferably 0.5 kg to 2 kg.

Preferably, the coated laundry detergent particle is such that at least 90 to 100% of the coated laundry detergent particles in the in the x, y and z dimensions are within a 20%, preferably 10%, variable from the largest to the smallest coated laundry detergent particle.

Water Content

The particle preferably comprises from 0 to 15 wt % water, more preferably 0 to 10 wt %, most preferably from 1 to 5 wt % water, at 293 K and 50% relative humidity. This facilitates the storage stability of the particle and its mechanical properties.

Other Adjuncts

The adjuncts as described below may be present in the coating or the core. These may be in the core or the coating.

Fluorescent Agent

The coated laundry detergent particle preferably comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 0.1 wt %. Suitable Fluorescer for use in the invention are described in chapter 7 of Industrial Pigments edited by K. Hunger 2003 Wiley-VCH ISBN 3-527-30426-6.

Preferred fluorescers are selected from the classes distyrylbiphenyls, triazinylaminostilbenes, bis(1,2,3-triazol-2-yl)stilbenes, bis(benzo[b]furan-2-yl)biphenyls, 1,3-diphenyl-2-pyrazolines and courmarins. The fluorescer is preferably sulfonated.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2 (4-styryl-3-sulfophenyl)-2H-napthol[1,2-d] triazole, disodium 4,4'-bis{[(4-anilino-6-(N methyl-N-2 hydroxyethyl)amino 1,3,5-triazin-2-yl)]amino}stilbene-2-2' disulfonate, disodium 4,4'-bis{[(4-anilino-6-morpholino-1,3,5-triazin-2-yl)]amino}stilbene-2-2' disulfonate, and disodium 4,4'-bis(2-sulfostyryl)biphenyl.

Tinopal® DMS is the disodium salt of disodium 4,4'-bis{[(4-anilino-6-morpholino-1,3,5-triazin-2-yl)]amino} stilbene-2-2' disulfonate. Tinopal® CBS is the disodium salt of disodium 4,4'-bis(2-sulfostyryl)biphenyl.

Perfume

Preferably the composition comprises a perfume. The perfume is preferably in the range from 0.001 to 3 wt %, most preferably 0.1 to 2 wt %. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

It is commonplace for a plurality of perfume components to be present in a formulation. In the compositions of the present invention it is envisaged that there will be four or more, preferably five or more, more preferably six or more or even seven or more different perfume components.

In perfume mixtures preferably 15 to 25 wt % are top notes. Top notes are defined by Poucher (Journal of the Society of Cosmetic Chemists 6 (2):80 [1955]). Preferred top-notes are selected from citrus oils, linalool, linalyl acetate, lavender, dihydromyrcenol, rose oxide and cis-3-hexanol.

It is preferred that the coated laundry detergent particle does not contain a peroxygen bleach, e.g., sodium percarbonate, sodium perborate, and peracid.

Polymers

The composition may comprise one or more further polymers. Examples are carboxymethylcellulose, poly(ethylene glycol), poly(vinyl alcohol), polyethylene imines, ethoxylated polyethylene imines, water soluble polyester polymers polycarboxylates such as polyacrylates, maleic/acrylic acid copolymers and lauryl methacrylate/acrylic acid copolymers.

Enzymes

One or more enzymes are preferred present in a composition of the invention.

Preferably the level of each enzyme is from 0.0001 wt % to 0.5 wt % protein on product.

Especially contemplated enzymes include proteases, alpha-amylases, cellulases, lipases, peroxidases/oxidases, pectate lyases, and mannanases, or mixtures thereof.

Suitable lipases include those of bacterial or fungal origin. Chemically modified or protein engineered mutants are included. Examples of useful lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas* lipase, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wis-*

*consinensis* (WO 96/12012), a *Bacillus* lipase, e.g. from *B. subtilis* (Dartois et al. (1993), Biochemica et Biophysica Acta, 1131, 253-360), *B. stearothermophilus* (JP 64/744992) or *B. pumilus* (WO 91/16422).

Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202, WO 00/60063, WO 09/107091 and WO09/111258.

Preferred commercially available lipase enzymes include Lipolase™ and Lipolase Ultra™, Lipex™ (Novozymes A/S) and Lipoclean™.

The method of the invention may be carried out in the presence of phospholipase classified as EC 3.1.1.4 and/or EC 3.1.1.32. As used herein, the term phospholipase is an enzyme which has activity towards phospholipids.

Phospholipids, such as lecithin or phosphatidylcholine, consist of glycerol esterified with two fatty acids in an outer (sn-1) and the middle (sn-2) positions and esterified with phosphoric acid in the third position; the phosphoric acid, in turn, may be esterified to an amino-alcohol. Phospholipases are enzymes which participate in the hydrolysis of phospholipids. Several types of phospholipase activity can be distinguished, including phospholipases $A_1$ and $A_2$ which hydrolyze one fatty acyl group (in the sn-1 and sn-2 position, respectively) to form lysophospholipid; and lysophospholipase (or phospholipase B) which can hydrolyze the remaining fatty acyl group in lysophospholipid. Phospholipase C and phospholipase D (phosphodiesterases) release diacyl glycerol or phosphatidic acid respectively.

Suitable proteases include those of animal, vegetable or microbial origin. Microbial origin is preferred. Chemically modified or protein engineered mutants are included. The protease may be a serine protease or a metallo protease, preferably an alkaline microbial protease or a trypsin-like protease. Preferred commercially available protease enzymes include Alcalase™, Savinase™, Primase™, Duralase™, Dyrazym™, Esperase™, Everlase™, Polarzyme™, and Kannase™, (Novozymes A/S), Maxatase™, Maxacal™, Maxapem™, Properase™, Purafect™, Purafect OxP™, FN2™, and FN3™ (Genencor International Inc.).

The method of the invention may be carried out in the presence of cutinase. classified in EC 3.1.1.74. The cutinase used according to the invention may be of any origin. Preferably cutinases are of microbial origin, in particular of bacterial, of fungal or of yeast origin.

Suitable amylases (alpha and/or beta) include those of bacterial or fungal origin. Chemically modified or protein engineered mutants are included. Amylases include, for example, alpha-amylases obtained from *Bacillus*, e.g. a special strain of *B. licheniformis*, described in more detail in GB 1,296,839, or the *Bacillus* sp. strains disclosed in WO 95/026397 or WO 00/060060. Commercially available amylases are Duramyl™, Termamyl™, Termamyl Ultra™, Natalase™, Stainzyme™, Fungamyl™ and BAN™ (Novozymes A/S), Rapidase™ and Purastar™ (from Genencor International Inc.).

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g. the fungal cellulases produced from *Humicola insolens, Thielavia terrestris, Myceliophthora thermophila*, and *Fusarium oxysporum* disclosed in U.S. Pat. No. 4,435,307, U.S. Pat. No. 5,648,263, U.S. Pat. No. 5,691,178, U.S. Pat. No. 5,776,757, WO 89/09259, WO 96/029397, and WO 98/012307. Commercially available cellulases include Celluzyme™, Carezyme™, Endolase™, Renozyme™ (Novozymes A/S), Clazinase™ and Puradax HA™ (Genencor International Inc.), and KAC-500(B)™ (Kao Corporation).

Suitable peroxidases/oxidases include those of plant, bacterial or fungal origin. Chemically modified or protein engineered mutants are included. Examples of useful peroxidases include peroxidases from *Coprinus*, e.g. from *C. cinereus*, and variants thereof as those described in WO 93/24618, WO 95/10602, and WO 98/15257. Commercially available peroxidases include Guardzyme™ and Novozym™ 51004 (Novozymes A/S).

Further enzymes suitable for use are disclosed in WO2009/087524, WO2009/090576, WO2009/148983 and WO2008/007318.

Enzyme Stabilizers

Any enzyme present in the composition may be stabilized using conventional stabilizing agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

Where alkyl groups are sufficiently long to form branched or cyclic chains, the alkyl groups encompass branched, cyclic and linear alkyl chains. The alkyl groups are preferably linear or branched, most preferably linear.

The indefinite article "a" or "an" and its corresponding definite article "the" as used herein means at least one, or one or more, unless specified otherwise. The singular encompasses the plural unless otherwise specified.

Sequesterants may be present in the coated laundry detergent particles.

It is preferred that the coated detergent particle has a core to shell ratio of from 3 to 1:1, most preferably 2.5 to 1.5:1; the optimal ratio of core to shell is 2:1.

EXPERIMENTAL

Core Manufacture

Surfactant raw materials were mixed together to give a 67 wt % active paste comprising 56 parts of anionic surfactant linear alkyl benzene sulphonate (Ufasan 65 ex Unger) LAS, 30 parts sodium lauryl ether sulphate, SLES (1 to 3 ethoxy groups) and 14 parts PAS Surfactant. The paste was preheated to the feed temperature and fed to the top of a wiped film evaporator to reduce the moisture content and produce a solid intimate surfactant blend, which passed the calcium tolerance test. The product was cooled and milled.

The resultant granular product was mixed with various levels, 0 wt % to 40 wt %, of calcite (Omya 40 and Omya 5) and fed to a twin-screw co-rotating extruder fitted with a shaped orifice plate and cutter blade.

The resulting extruded pellets were hygroscopic and so were stored in sealed containers. These were then coated with sodium carbonate in a fluidbed.

The particles were oblate elipisoids which had the following approximate dimensions x=1.0 mm, y=4.0 mm and z=5.0 mm Coating The core particles were coated with Sodium carbonate (particle 1) or CP5 (particle 2 reference) by spray. The extrudates above were charged to the fluidising chamber of a Strea 1 laboratory fluid bed drier (Aeromatic-Fielder AG) and spray coated using the coating solution using a top-spray configuration. The coating solution was fed to the spray nozzle of the Strea 1 via a peristaltic pump (Watson-Marlow model 101 U/R). The conditions used for the coating are given in the table below:

| | Particle |
|---|---|
| Mass extrudate [g] | 800 |
| Coating Solution [g] | 420 $Na_2CO_3$<br>980 $H_2O$ |
| Air Inlet Temperature [° C.] | 90 |
| Air Outlet Temperature [° C.] | 39 |
| Coating Feed Rate [g/min] | 35 |
| Coating Feed temperature [° C.] | 50 |

Example—Pellet Manufacture, Calcite in Core

Core particle with 20% Omya 40

800 g of dried, milled surfactant blend (LAS/PAS/SLES.3eo (58.3-14.6-27.1 by weight) was thoroughly mixed with 200 g of Omya 40 calcite.

Similarly, blends were prepared with 0-40% Omya 40 calcite and 10-20% of Omya 5 calcite.

The mixtures were then extruded using a Thermo Fisher 24HC twin screw extruder, operated at a rate of 8 kg/hr. Inlet temperature of the extruder was set at 15° C., rising to 40° C. just prior to the die-plate. The die-plate used was drilled with 6 circular orifices of 5 mm diameter.

The extruded products were cut after the die-plate using a high speed cutter set up to produce particle with a thickness of ~1.0 mm.

(Coating)

800 g of the extrudates above were charged to the fluidising chamber of a Strea 1 laboratory fluid bed drier (Aeromatic-Fielder AG) and spray coated using 1400 g of a solution containing 420 g of sodium carbonate, using a top-spray configuration.

The coating solution was fed to the spray nozzle of the Strea 1 via a peristaltic pump (Watson-Marlow model 101U/R) at an initial rate of 3 g/min, rising to 9 g/min during the course of the coating trial.

The Fluid bed coater was operated with an initial air inlet air temperature of 55° C. increasing to 90° C. during the course of the coating trial whilst maintaining the outlet temperature in the range 35-40° C. throughout the coating process.

Storage Method and Results

Coated granules, 180 g, were put into a plain card box, open at the lid. The samples were stored in an environment set at 27° C. 70% rh for 2 weeks and 4 weeks. After that time the boxes were removed and tested for pouring and crystal feel.

1) Storage results for pellets containing Omya 40 (all coated with sodium carbonate).

| Sample | 2 Weeks Storage | | 4 Weeks Storage | |
|---|---|---|---|---|
| LAS/NI coated base | Free flowing | Moderately Crisp | Slightly sluggish | Moderately Crisp |
| LAS/PAS/SLES coated base | sluggish | Moderately soft | Sluggish | Soft |
| LAS/PAS/SLES + 10% Omya 40 calcite | Free flowing | Moderately soft | Sluggish | Soft |
| LAS/PAS/SLES + 20% Omya 40 calcite | Free flowing | Moderately Crisp | Slightly sluggish | Soft |
| LAS/PAS/SLES + 30% | Free | Crisp | Free | Moderately |

-continued

| Sample | 2 Weeks Storage | | 4 Weeks Storage | |
|---|---|---|---|---|
| Omya 40 calcite | flowing | | flowing | Crisp |
| LAS/PAS/SLES + 40% Omya 40 calcite | Free flowing | Crisp | Free flowing | Moderately Crisp |

From the results we conclude that:

Calcite of the appropriate D50 improves storage behaviour with respect to product handling.

The integrity of a LAS/PAS/SLES particle with a coating of 30% sodium carbonate is improved by the inclusion of calcite in the core.

The incorporation of calcite of appropriate D50 size would stabilise the solid surfactant core.

Omya 40 calcite was measured having the following size distribution 10% (1.93 micron), distribution 50% (24.01 micron) and distribution 90% (70.08 micron).

Key to Symbols and Rating Used in Classifying Storage Behaviour

| Flow of powder is assessed after pack is opened and inverted | Feel Determined by touch |
|---|---|
| F = Free flowing | C = Crisp |
| SS = Slightly sluggish | MC = Moderately crisp |
| S = Sluggish | MS = Moderately soft |
| L = Lumps | S = Soft |
| SC = Slightly creepy | M = Moist |
| No Flow | W = Wet |

2) Storage results for pellets containing Omya 5 (all coated with sodium carbonate).

| Sample | 2 Weeks Storage | | 4 Weeks Storage | |
|---|---|---|---|---|
| LAS/PAS/SLES + 10% Omya 5 calcite | Free flowing | Soft | Did not flow | Soft |
| LAS/PAS/SLES + 20% Omya 5 calcite | Free flowing | Moderately Crisp | Did not flow | Moderately Crisp |

From the results we conclude that calcite of D50 4.22 micron improves storage behaviour at 2 weeks but appears to have a deleterious effect after 4 weeks storage.

Omya 5 calcite was measured having the following size distribution 10% (0.70 micron), distribution 50% (4.22 micron), and distribution 90% (14.88 micron).

We claim:

1. A coated detergent particle having a lenticular or an oblate ellipsoid shape with perpendicular dimensions x, y and z, wherein x is from 0.5 to 2 mm, y is from 2 to 8 mm, and z is from 2 to 8 mm, wherein the particle comprises:

(i) from 20 to 39 wt % of an anionic surfactant;

(ii) from 10 to 40 wt % of sodium carbonate; and, (iii) from 30 to 40 wt % of calcite having a median particle size average diameter (D50) in the range from 10 to 70 microns, and wherein the sodium carbonate is present on the detergent particle as a coating and the surfactant is present in a core with the calcite dispersed through the core.

2. A coated detergent particle according to claim 1, wherein the D50 particle size of the calcite is from 15 to 40 microns.

3. A coated detergent particle according to claim 1, wherein the D50 particle size of the calcite is from 20 to 40 microns.

4. A coated detergent particle according to claim 1, wherein the coated detergent particle comprises 35 wt % calcite.

5. A coated detergent particle according to claim 1, wherein the sodium carbonate is present in the range from 10 to 30 wt %.

6. A coated detergent particle to claim 1, wherein the particle comprises from 0.5 to 5 wt % water.

7. The coated detergent particle according to claim 1 further comprising one or more adjuncts selected from the group consisting of optical brighteners, perfumes, polymers, enzymes, enzyme stabilizers, and sequestrants.

8. The coated detergent particle according to claim 1, wherein the anionic surfactant is selected from the group consisting of water soluble alkali metal salts of organic sulphates and sulphonates having alkyl radicals containing from 8 to 22 carbon atoms.

9. The coated detergent particle according to claim 1, wherein the anionic surfactant is selected from the group consisting of sodium lauryl ether sulfates having 1 to 3 ethoxy groups, sodium $C_{10}$-$C_{15}$ alkyl benzene sulphonates and sodium $C_{12}$ to $C_{18}$ alkyl sulphates.

10. A plurality of coated detergent particles according to claim 1, wherein at least 90 to 100% of the coated detergent particles in the x, y and z dimensions are within a 20% variation from the largest to the smallest coated detergent particle.

11. A laundry detergent formulation comprising coated detergent particles according to claim 1, wherein at least 90 to 100% of the coated detergent particles in the x, y and z dimensions are within a 20% variation from the largest to the smallest coated detergent particle.

12. The laundry detergent formulation according to claim 11, wherein the coated detergent particle comprises from 30 to 40 wt % calcite, the D50 particle size of the calcite is from 20 to 40 microns, the sodium carbonate is present in the range from 10 to 30 wt %, and particle comprises from 0.5 to 5 wt % water at 293K and 50% relative humidity.

13. The laundry detergent formulation according to claim 12, wherein the coated detergent particle comprises an anionic surfactant selected from the group consisting of sodium lauryl ether sulfates having 1 to 3 ethoxy groups, sodium $C_{10}$-$C_{15}$ alkyl benzene sulphonates and sodium $C_{12}$ to $C_{18}$ alkyl sulphates.

14. A coated detergent particle having perpendicular dimensions x, y and z, wherein x is from 0.5 to 2 mm, y is from 2 to 8 mm, and z is from 2 to 8 mm, wherein the particle comprises:

(i) from 20 to 39 wt % of an anionic surfactant;

(ii) from 10 to 40 wt % of sodium carbonate; and, (iii) from 30 to 40 wt % of calcite having a median particle size average diameter (D50) in the range from 10 to 70 microns, and wherein the sodium carbonate is present on the detergent particle as a coating and the surfactant is present in a core with the calcite dispersed through the core.

15. The coated detergent particle according to claim 14, wherein the D50 particle size of the calcite is from 20 to 40 microns.

16. The coated detergent particle according to claim 14, wherein the anionic surfactant is selected from the group consisting of water soluble alkali metal salts of organic sulphates and sulphonates having alkyl radicals containing from 8 to 22 carbon atoms.

17. The coated detergent particle according to claim 14, wherein the anionic surfactant is selected from the group consisting of sodium lauryl ether sulfates having 1 to 3 ethoxy groups, sodium $C_{10}$-$C_{15}$ alkyl benzene sulphonates and sodium $C_{12}$ to $C_{18}$ alkyl sulphates.

18. The coated detergent particle according to claim 14, wherein the core further comprises nonionic surfactant selected from the group consisting of alkylene oxide condensates of aliphatic alcohols, aliphatic acids, aliphatic amides, and alkyl phenols.

19. The coated detergent particle according to claim 1, wherein the core further comprises nonionic surfactant selected from the group consisting of $C_6$-$C_{22}$ alkyl phenol-ethylene oxide condensate having 5 to 25 units of ethylene oxide per molecule (EO) and $C_8$-$C_{18}$ primary or secondary linear or branched alcohols with 5-50 EO.

* * * * *